US008235881B2

(12) United States Patent
Pollock

(10) Patent No.: US 8,235,881 B2
(45) Date of Patent: Aug. 7, 2012

(54) FOLDER WITH SIGNATURE SUPPORT AND METHOD

(75) Inventor: David Clarke Pollock, Somersworth, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 13/025,688

(22) Filed: Feb. 11, 2011

(65) Prior Publication Data

US 2011/0136643 A1 Jun. 9, 2011

Related U.S. Application Data

(62) Division of application No. 11/258,494, filed on Oct. 25, 2005, now Pat. No. 7,896,795.

(51) Int. Cl.
*B31F 1/10* (2006.01)

(52) U.S. Cl. ..... 493/432; 493/428; 493/424

(58) Field of Classification Search ..... 493/424–428, 493/434–435, 442
See application file for complete search history.

(56) References Cited

U.S. PATENT DOCUMENTS

| | | | | |
|---|---|---|---|---|
| 4,036,487 | A * | 7/1977 | Heimlicher et al. | 493/428 |
| 5,039,076 | A * | 8/1991 | Fischer | 270/47 |
| 5,405,126 | A * | 4/1995 | Mack | 270/6 |
| 5,547,452 | A * | 8/1996 | Kepert et al. | 493/427 |
| 6,093,139 | A | 7/2000 | Belanger | |
| 6,250,622 | B1 * | 6/2001 | Fowler et al. | 270/47 |
| 6,551,227 | B1 * | 4/2003 | Whitten | 493/356 |
| 6,605,027 | B1 * | 8/2003 | Cloutier et al. | 493/424 |
| 6,752,751 | B2 * | 6/2004 | Jackson et al. | 493/428 |
| 6,843,763 | B2 * | 1/2005 | Jackson et al. | 493/428 |
| 6,923,753 | B2 | 8/2005 | Jackson et al. | 493/432 |
| 7,011,617 | B2 * | 3/2006 | Sappal et al. | 493/424 |
| 7,255,668 | B2 * | 8/2007 | Janzen | 493/432 |
| 7,311,651 | B2 * | 12/2007 | Stab | 493/428 |
| 2003/0110968 | A1 * | 6/2003 | Jackson et al. | 101/409 |

FOREIGN PATENT DOCUMENTS

| | | |
|---|---|---|
| DE | 32 40 581 A1 | 5/1983 |
| JP | 57-33161 | 2/1982 |
| JP | 57-42456 | 3/1982 |
| JP | 58-51149 | 3/1983 |
| JP | 58-82951 | 5/1983 |
| JP | 2002-120968 | 4/2002 |
| JP | 2003-182932 | 7/2003 |

OTHER PUBLICATIONS

Carriere, Rob and Randolph L. Moses, "High Resolution Radar Target Modeling Using a Modified Prony Estimator" IEEE Transactions on Antennas and Propagation. vol. 40, No. 1. Jan. 1992. 13 to 19. Print.

* cited by examiner

*Primary Examiner* — Lindsay Low
(74) *Attorney, Agent, or Firm* — Davidson, Davidson & Kappel, LLC

(57) ABSTRACT

A method for folding signatures is provided. The method includes the steps of forcing a trail edge of a first signature away from a folding cylinder using a signature support, tucking a second signature held by a gripper using a tucker at a first fold location and performing a mode change to tuck a further signature at a second fold location different from the first fold location, the mode change including moving the gripper and the signature support automatically with respect to the tucker. A signature support is also provided.

20 Claims, 4 Drawing Sheets

FOLDER WITH SIGNATURE SUPPORT AND METHOD

CROSS-REFERENCE TO RELATED APPLICATIONS

This is a divisional of U.S. application Ser. No. 11/258,494 filed Oct. 25, 2005, the entire disclosure of which is hereby incorporated by reference herein.

BACKGROUND

The present invention relates to folders for printing presses.

U.S. Pat. No. 6,843,763, hereby incorporated by reference herein, describes a folder with a folding cylinder having a support plate. A plurality of grippers are fixed to a rotatable base. The cylinder also has a plurality of tucking blades. The grippers are rotatable with respect to the tucking blades for production of signatures of different fold lengths. The grippers operate through slots in the support plate. The trailing edge of the signatures aligns to the cylinder just ahead of the grippers, which operate on the lead edge of a succeeding signature.

To support trailing edges of signatures to prevent for example dog-earring, foam pads have been known. The foam pad is applied, for example with adhesive, on the outer circumference of the cylinder ahead of the grippers. If the folding cylinder is reconfigured for a different length, the pad is manually repositioned.

U.S. Pat. Nos. 6,093,139 and 6,551,227 show signature hold-down devices on cutting cylinders, and are hereby incorporated by reference herein.

SUMMARY OF THE INVENTION

The present invention provides a folder comprising:

a jaw cylinder;

a folding cylinder including a gripper for gripping an edge of a first signature and a tucking blade for tucking the first signature into the jaw cylinder, the folding cylinder including a signature support supporting a second signature against the jaw cylinder, the signature support and the gripper being movable automatically together with respect to the tucking blade.

By having the gripper and signature support move together without manual readjustment of the signature support, make-ready time can be reduced while dog-earring and any other problems associated with free trailing edges of signatures are still avoided.

Preferably, the folding cylinder has a gripper support, the gripper and the signature support both being supported on the gripper support. The gripper support may be for example a spider rotatable with respect to a tucker spider.

The folding cylinder may include a support plate having a plurality of longitudinally extending slots, the gripper passing through the slots to grip the signatures. The signature support may include a plurality of flexible elements passing through the slots.

The elements may be flexible at least for contacting the signatures, for example the elements may be rigid metal fingers with flexible foam pads attached, or may be entirely made of flexible material, for example spring steel.

When the folding cylinder does not have a support plate, the signature support could be for example a single element extending laterally across a width of the cylinder or a plurality of elements.

The gripper preferably grips the lead edge and the signature support supports a trail edge of the second signature.

The present invention also provides a transfer cylinder including a gripper for gripping an edge of a first signature, the transfer cylinder including a signature support contacting a second signature to force the second signature radially away from the transfer cylinder, the signature support and the gripper being movable automatically together.

The present invention also provide a method for folding signatures comprising:

forcing a trail edge of a first signature away from a folding cylinder using a signature support;

tucking a second signature held by a gripper using a tucker at a first fold location; and performing a mode change to tuck a further signature at a second fold location different from the first fold location, the mode change including moving the gripper and the signature support automatically with respect to the tucker.

Thus a mode change, for example from a delta fold to a quarter fold, can be performed with the signature support moving automatically.

The present invention also provides a signature support including a base; a plurality of connectors for connecting the base to a radially interior support of a cylinder; and a flexible element attached to the base.

Gripper as defined herein may include a gripper grabbing a signature around the edge, or pins which pierce the edge. Signature as herein may include a single sheet or a plurality of sheets. Jaw cylinder as recited herein includes any cylinder for receiving a tucked signature.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
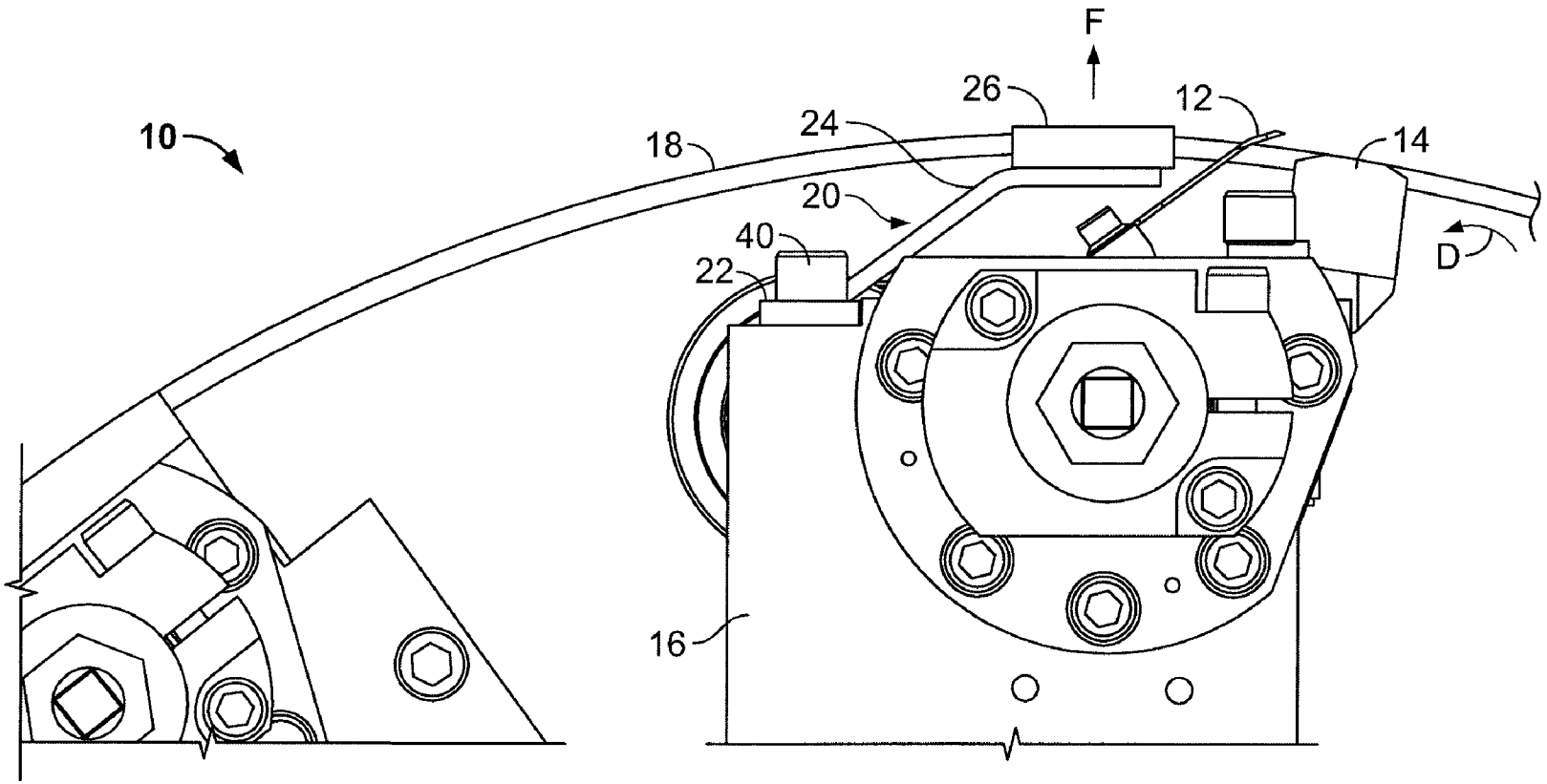
FIG. 1 shows a section of the folding cylinder according to the present invention.

FIG. 1 shows a transfer cylinder, here a folding cylinder 10 including a slotted cylinder cover 18 as described for example in U.S. Pat. No. 6,843,763. Grippers 12 are actuatable, for example via a cam follower, to grip a signature against a gripper seat 14. Grippers 12 are rotatably supported on a gripper support 16. There may be for example three or four gripper supports spaced circumferentially around the cylinder 10 via a hub to define a gripper spider.

Fixedly attached to support 16 is a signature support 20. Signature support 20 includes a mounting bar 22 and a plurality of support fingers 24. At the end of each support finger in the preferred embodiment described here are foam pads 26 passing through the slotted cover 18 ahead of the grippers 12 in the direction of rotation D. In this embodiment, foam pads 26 can compress and constrain a trail edge of a signature passing through a nip with a jaw cylinder via a radial force F.

Screws or nuts or another connecting device 40, preferably with threads for easy fastening, can be used to fasten the mounting bar to the support 16.

Figure 2:
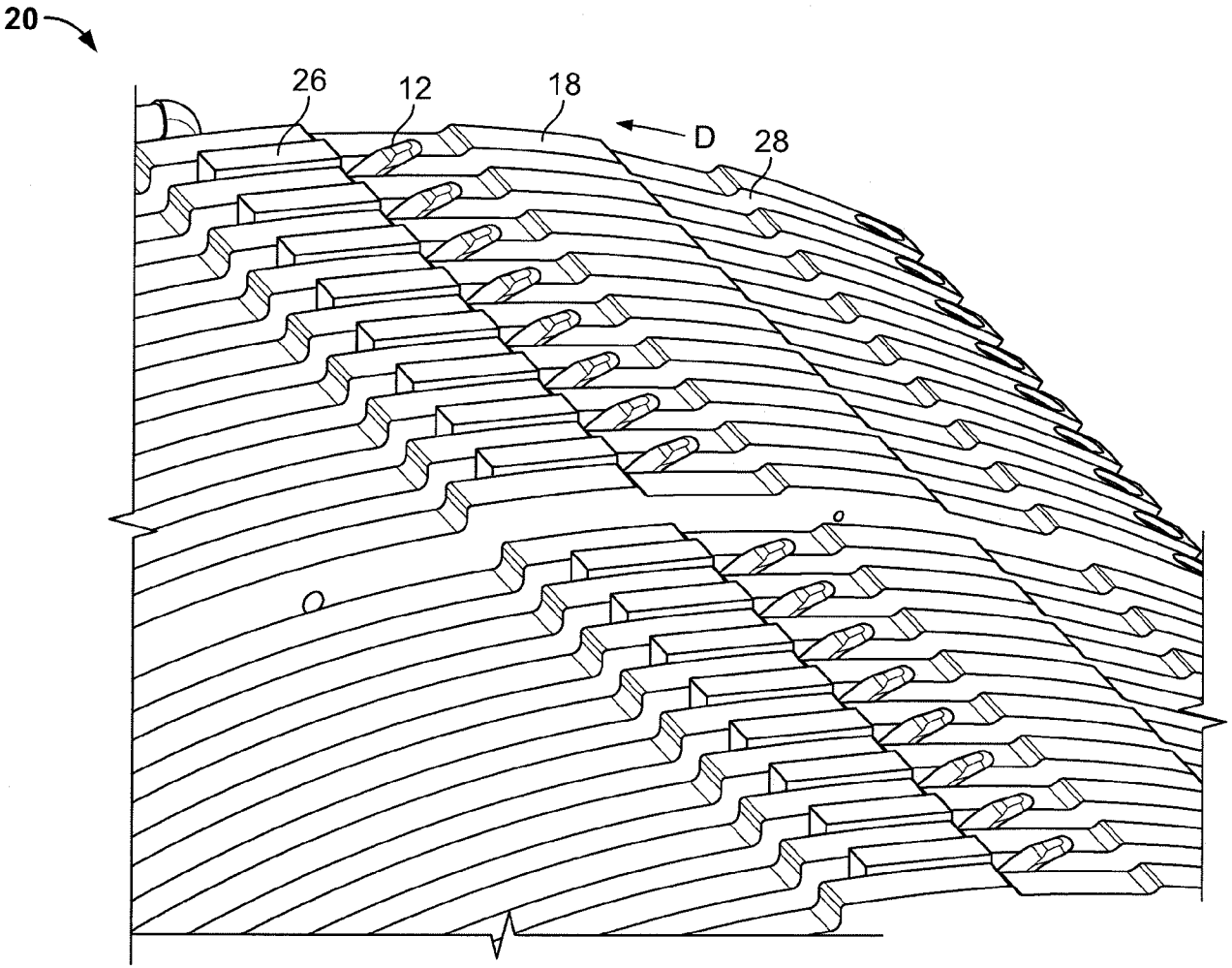
FIG. 2 shows an outer circumferential section of the folding cylinder according to the present invention.

FIG. 2 shows the grippers 12 and foam pads 26 extending through slots 28 of the slotted cover 18.

Figure 3:
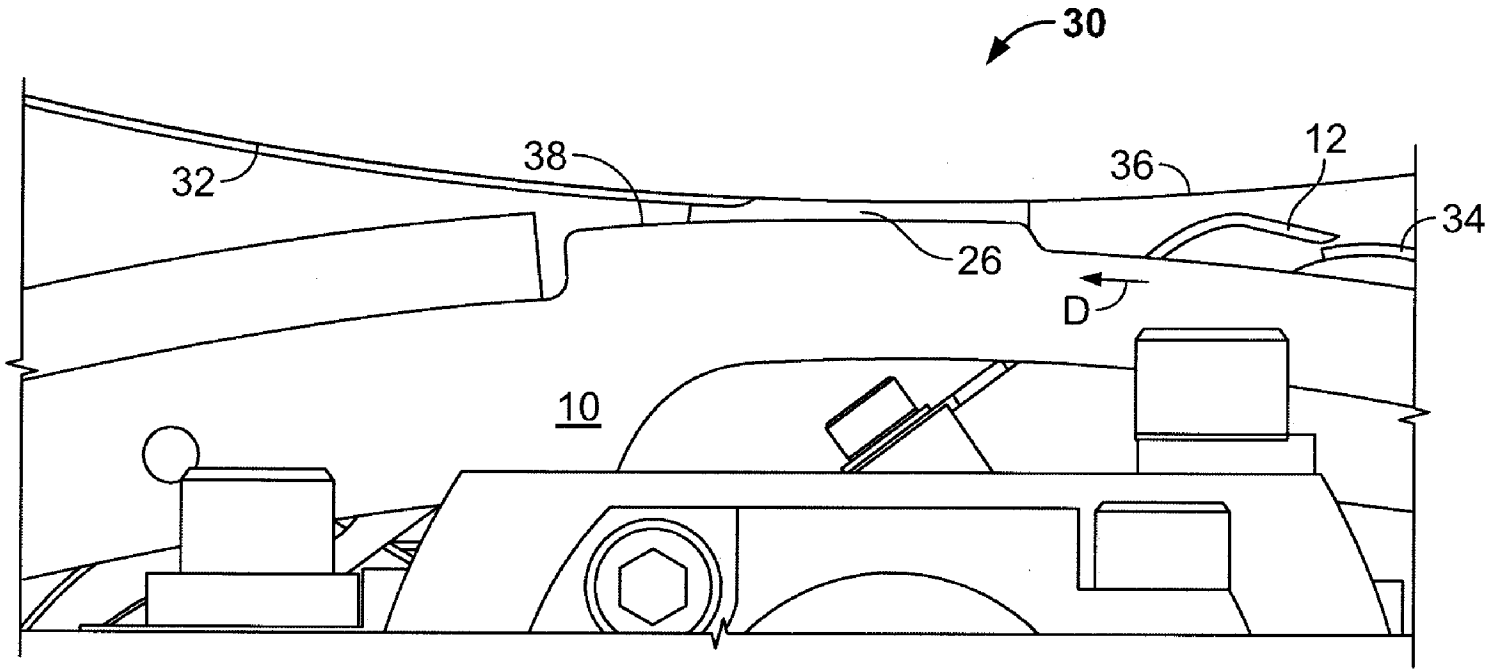
FIG. 3 shows a section of the folder of according to the present invention.

FIG. 3 shows a folder of the present invention with a jaw cylinder 30 having received a folded signature 32 from folding cylinder 10. Foam pad 26 presses the signature 32 against the outer circumference 36 of jaw cylinder 30, and away from the outer circumference 38 of the folding cylinder 10. Gripper 12 then delivers a next signature 34 to be folded.

Figure 4B:
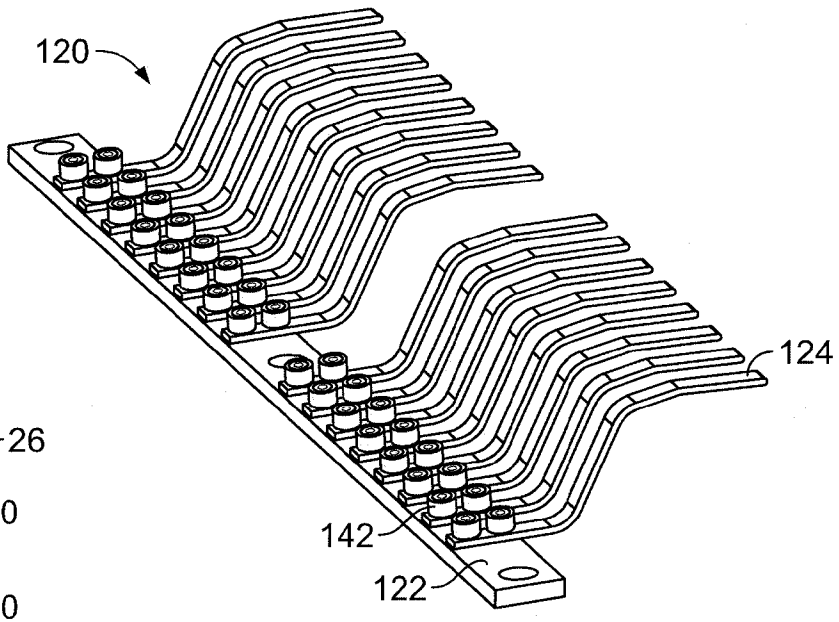
FIGS. 4*a* and 4*b* show two embodiments of signature supports used in the present invention.
Figure 4A:
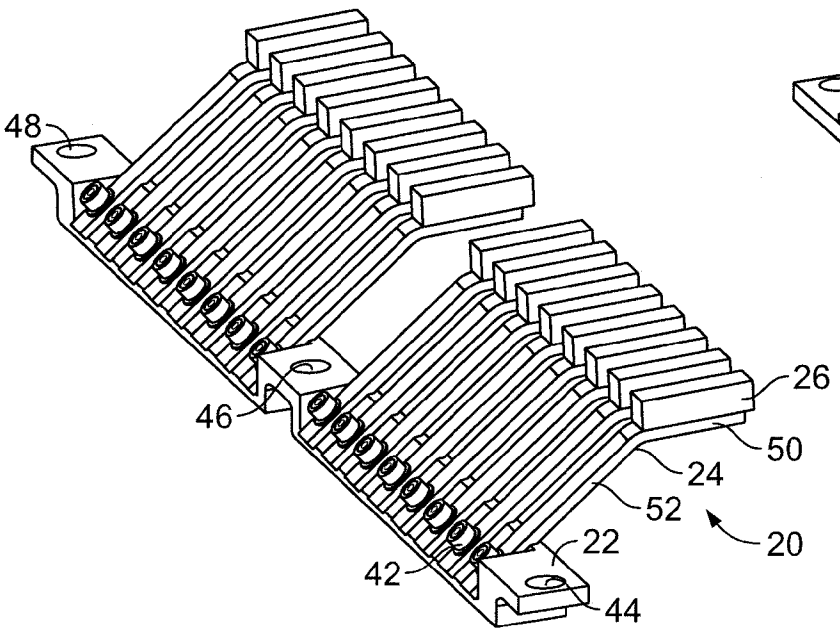

FIG. 4*a* shows the signature support 20. Mounting bar 22 may have for example three holes 44, 46, 48 for connecting devices 40 to fasten the support 20 to the gripper support 16. The fingers 24 may be made of steel and be inflexible, and be attached via connectors 42 to bar 22. The foam pads 26 may be for example attached adhesively to a generally flat area 50 of a finger 24, the flat area being angled with respect to an angled body portion 52 of the finger 24.

FIG. 4*b* shows an alternate embodiment of the signature support 20, here a signature support 120. Fingers 124 are mounted to a mounting bar 122 via dual connectors 142, and are made of spring steel or other material flexible enough to permit passage of the fingers and proper signature support through a nip between the jaw cylinder 30 and folding cylinder 10.

What is claimed is:

1. A method for folding signatures comprising:

forcing a trail edge of a first signature away from a folding cylinder using a signature support;

tucking a second signature held by a gripper using a tucker at a first fold location;

performing a mode change to tuck a further signature at a second fold location different from the first fold location, the mode change including moving the gripper and the signature support automatically with respect to the tucker; and passing the gripper through slots in a support plate of the folding cylinder so the gripper grips the further signature.

2. The method as recited in claim 1 wherein the step of forcing a trail edge of the first signature includes passing a plurality of flexible elements of the signature support through the slots.

3. The method as recited in claim 1 further comprising the step of:

gripping a lead edge of the first signature with the gripper and supporting the trail edge of the second signature with the signature support.

4. The method as recited in claim 1 wherein the step of performing a mode change includes changing from a delta fold to a quarter fold.

5. The method as recited in claim 2 wherein the plurality of flexible elements of the signature support are passed through the slots ahead of the gripper.

6. The method as recited in claim 1 wherein the step of forcing a trail edge of the first signature includes contacting the trail edge of the first signature against a jaw cylinder.

7. A method for folding signatures comprising:

forcing a trail edge of a first signature away from a folding cylinder using a signature support, the signature support including a base, a plurality of connectors for connecting the base to a radially interior support of the folding cylinder and a flexible element attached to the base;

tucking a second signature held by a gripper using a tucker at a first fold location; and performing a mode change to tuck a further signature at a second fold location different from the first fold location, the mode change including moving the gripper and the signature support automatically with respect to the tucker.

8. The method as recited in claim 7 further comprising the step of passing the gripper through slots in a support plate of the folding cylinder so the gripper grips the further signature.

9. The method as recited in claim 8 wherein the step of forcing a trail edge of the first signature includes passing a plurality of flexible elements of the signature support through the slots.

10. The method as recited in claim 9 wherein the plurality of flexible elements of the signature support are passed through the slots ahead of the gripper.

11. The method as recited in claim 7 further comprising the step of:

gripping a lead edge of the first signature with the gripper and supporting the trail edge of the second signature with the signature support.

12. The method as recited in claim 7 wherein the step of performing a mode change includes changing from a delta fold to a quarter fold.

13. The method as recited in claim 7 wherein the step of forcing a trail edge of the first signature includes contacting the trail edge of the first signature against a jaw cylinder.

14. A method for folding signatures comprising:

forcing a trail edge of a first signature away from a folding cylinder using a signature support by pressing, compressing or constraining the trail edge of the first signature against a jaw cylinder, tucking a second signature held by a gripper using a tucker at a first fold location; and performing a mode change to tuck a further signature at a second fold location different from the first fold location, the mode change including moving the gripper and the signature support automatically with respect to the tucker.

15. The method as recited in claim 14 further comprising the step of passing the gripper through slots in a support plate of the folding cylinder so the gripper grips the further signature.

16. The method as recited in claim 15 wherein the step of forcing a trail edge of the first signature includes passing a plurality of flexible elements of the signature support through the slots.

17. The method as recited in claim 16 wherein the plurality of flexible elements of the signature support are passed through the slots ahead of the gripper.

18. The method as recited in claim 14 further comprising the step of:

gripping a lead edge of the first signature with the gripper and supporting the trail edge of the second signature with the signature support.

19. The method as recited in claim 14 wherein the step of performing a mode change includes changing from a delta fold to a quarter fold.

20. The method as recited in claim 14 wherein the step of forcing a trail edge of the first signature includes contacting the trail edge of the first signature against a jaw cylinder.

* * * * *